US005909877A

United States Patent [19]

Bour

[11] Patent Number: 5,909,877

[45] Date of Patent: Jun. 8, 1999

[54] BEAN BAG TOSS GAME TARGET

[75] Inventor: Anthony William Bour, Sioux Falls, S. Dak.

[73] Assignee: Sunstream Manufacturing Inc., Sioux Falls, S. Dak.

[21] Appl. No.: 08/940,432

[22] Filed: Sep. 30, 1997

[51] Int. Cl.[6] ..... A63B 63/00

[52] U.S. Cl. ..... 273/402

[58] Field of Search ..... 273/401, 402

[56] References Cited

U.S. PATENT DOCUMENTS

| | | | |
|---|---|---|---|
| D. 363,953 | 11/1995 | Buse . | |
| D. 375,125 | 10/1996 | Mallek et al. . | |
| D. 375,530 | 11/1996 | Rudd . | |
| 431,211 | 7/1890 | Merrill . | |
| 827,626 | 7/1906 | Gillet . | |
| 922,717 | 5/1909 | Parker . | |
| 1,279,654 | 9/1918 | Charlesworth . | |
| 1,636,920 | 7/1927 | Nichols . | |
| 3,001,791 | 9/1961 | Atwood . | |
| 3,628,793 | 12/1971 | Mudloff . | |
| 3,837,650 | 9/1974 | Habney . | |
| 4,323,250 | 4/1982 | Lansberry | 273/400 |
| 4,726,591 | 2/1988 | Johnson | 273/339 |
| 4,805,918 | 2/1989 | Feinberg | 273/380 |
| 4,938,485 | 7/1990 | Hockridge et al. | 273/401 |
| 4,943,065 | 7/1990 | DeLapa | 273/402 |
| 4,961,586 | 10/1990 | Conville | 273/402 |
| 5,165,695 | 11/1992 | Yoder | 273/402 |

*Primary Examiner*—William H. Grieb
*Attorney, Agent, or Firm*—Merchant, Gould Smith, Edell Welter & Schmidt

[57] ABSTRACT

A bag tossing game target having first and second generally planar, equally sized panels that are connected together by a hinge. The first and second panels are moveable between a first, in-use configuration in which the first and second panels are coplanar, and a second, folded configuration in which the first and second panels lay back-to-back to each other. The first panel has a hole therein which is sized such that a bag can be tossed therethrough. The first and second panels each include an elongated hole adjacent one edge to form a handle by which the folded target can be carried. The panels are formed of a lattice structure to render the target lightweight. Further, the thickness of the lattice structure is reduced whereby a series of pockets are defined between the panels when folded. Elongated support legs are provided which can be detachably secured to one of the panels at one end and rest upon the ground at the other end to support one of the panels above the ground while an end of the other panel rests upon the ground. The legs are sized and shaped such that when detached from the panel, the legs can be nested within one of the pockets when the panels are folded. In this way, the legs are retained within the folded target, reducing the chances that the legs will be misplaced. The bags used during play of the game can also be nested within the pockets.

20 Claims, 7 Drawing Sheets

BEAN BAG TOSS GAME TARGET

FIELD OF THE INVENTION

This invention relates to a bean bag toss game, and more particularly to a target for a bean bag toss game which is readily foldable for transport and storage, and yet can be unfolded into a sturdy structure for use during play of the game.

BACKGROUND OF THE INVENTION

Bag tossing games are popular because they are safe and fun to play for people of all ages, and can be transported to, and played in, almost any location. Such games generally have few parts and can be set up relatively quickly, which further adds to the appeal of these games, particularly for children for whom a complicated and difficult set-up procedure may tend to discourage them from playing a game. Since these games are transportable, they are made to be as lightweight as possible to make transport thereof easier, while still providing a sturdy structure for use during game play.

Bag tossing games generally include a target structure having a hole through which players try to toss, pitch, or otherwise project, bean filled bags or the like. A myriad of target devices are known in the prior art. For instance, U.S. Pat. No. 3,837,650 to Haney discloses a target device that utilizes two sheets hinged together, with a brace pivotally secured to one of the sheets and engaged with the opposite sheet, thus forming a foldable target. However, the two sheets are hinged together in a manner such that one sheet is shorter than the other sheet, which would make carrying of the folded sheets difficult since the shorter sheet would often times tend to rotate toward the unfolded position. Further, due to a lack of a handle or similar structure, carrying of the folded target would be difficult for young and old alike. In addition, the brace must be specially locked with locking structure provided on the opposite sheet, which would make set-up of the target difficult for children to accomplish, thus deterring children from using the game.

U.S. Pat. No. 4,943,065 to DeLapa discloses a box-like target structure that is foldable for storage purposes, and which utilizes a handle to facilitate carrying of the folded structure. The target structure includes an upper planar, flexible member having a hole formed therein to allow passage of a bag. Front, rear and side support members are hingedly attached to the flexible member to support the member at an angle above the ground. However, the large number of support members needed to support the flexible member would make it difficult to set-up the target, since adjacent edges must be secured together in order to provide a rigid structure. Further, the use of the handle requires a complicated attachment/detachment procedure of the handle each time the target is folded/unfolded, which would make the target difficult to use, particularly for children.

Further, each of the above noted folding target structures require that the user separately carry the bags associated with the game, since no provision is made for carrying the bags along with the folded structure. This can often result in the bags being separated from the target structure and lost, rendering the game useless until additional bags are obtained.

Therefore, there is a continuing need for an improved target structure that is lightweight, foldable and is easily carried during transport, yet which can be set-up into a sturdy structure in an easy manner. Further, there exists a need for a bag toss game in which the bags can be carried along with the folded target structure.

SUMMARY OF THE INVENTION

Therefore the general purpose of the present invention is to provide a target for a bag toss game, and a bag toss game that utilizes the target, wherein the target is easily and simply folded for transport and storage, yet which can be easily set-up into an unfolded, sturdy, in-use configuration. The target is also provided with handle structure to facilitate carrying thereof and is light in weight to make carrying easier. The target is constructed so that the bags used in playing the game can be carried by the folded target, to prevent the bags from being misplaced.

A preferred embodiment of the target structure in accordance with the principles of the present invention includes first and second generally planar, equally sized panels that are connected together by a hinge whereby the first and second panels are moveable between a first, in-use configuration in which the first and second panels are coplanar, and a second, folded configuration in which the first and second panels lay back-to-back to each other. The first panel has a hole therein which is sized such that a bag can be tossed therethrough. The first and second panels each include an elongated hole adjacent one edge. By making the panels of equal size, the elongated holes in the bottom edges are aligned when the panels are folded, thus forming a convenient handle by which the folded target can be carried.

In accordance with the present invention, the panels are formed of a lattice, honeycomb, or like structure, to render the target lightweight, with reinforcing ribs disposed on the lattice structure at various locations for providing added strength. The ribs on the panels are aligned with each other, such that when the panels are folded together, the corresponding ribs on the panels are adjacent to each other. Further, the thickness of the lattice structure is less than the thickness of the ribs, whereby a series of pockets are defined by the aligned ribs and the lattice structure when the panels are folded. Elongated support legs, also of a lattice, honeycomb or like structure, are provided, which can be detachably secured to one of the panels at one end and rest upon the ground at the other end to support the one panel off the ground when in the in-use configuration, as an end of the other panel rests upon the ground. The legs are sized and shaped such that when detached from the panel, the legs can be nested within one of the pockets when the panels are folded. In this way, the legs are retained within the folded target, reducing the chances that the legs will be misplaced during transport and/or storage of the target.

The invention also provides for a bag toss game which utilizes at least one, preferably two, of the above described targets, along with a plurality of bags for use in playing the game. Preferably, there are a plurality of the bags associated with each target, with the bags being sized and shaped such that they can be nested within the pockets when the panels are folded. In this manner, the bags, like the legs, are retained within the folded target, thus reducing the likelihood that the bags will be lost during transport and/or storage of the target. Therefore, all the elements required for playing the game are retained together by utilizing the foldable target to carry the support legs and bags therein, with the target being specifically designed to facilitate carrying thereof.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DESCRIPTION OF THE PREFERRED EMBODIMENT

Referring now to FIGS. 1–4, it can be seen that the bag tossing game includes a game target 10 formed by first 12 and second 14 panels. The panels 12,14 are generally planar and are of equal size. The panels are formed by injection molding of a polymeric material, preferably polypropylene plastic and the like, so that each panel is generally stiff and rigid. However, it should be realized that the panels could be formed by other methods and using lightweight materials other than plastics and the like, such as fiber reinforced composites, so long as the panels are stiff and rigid.

Figure 1:
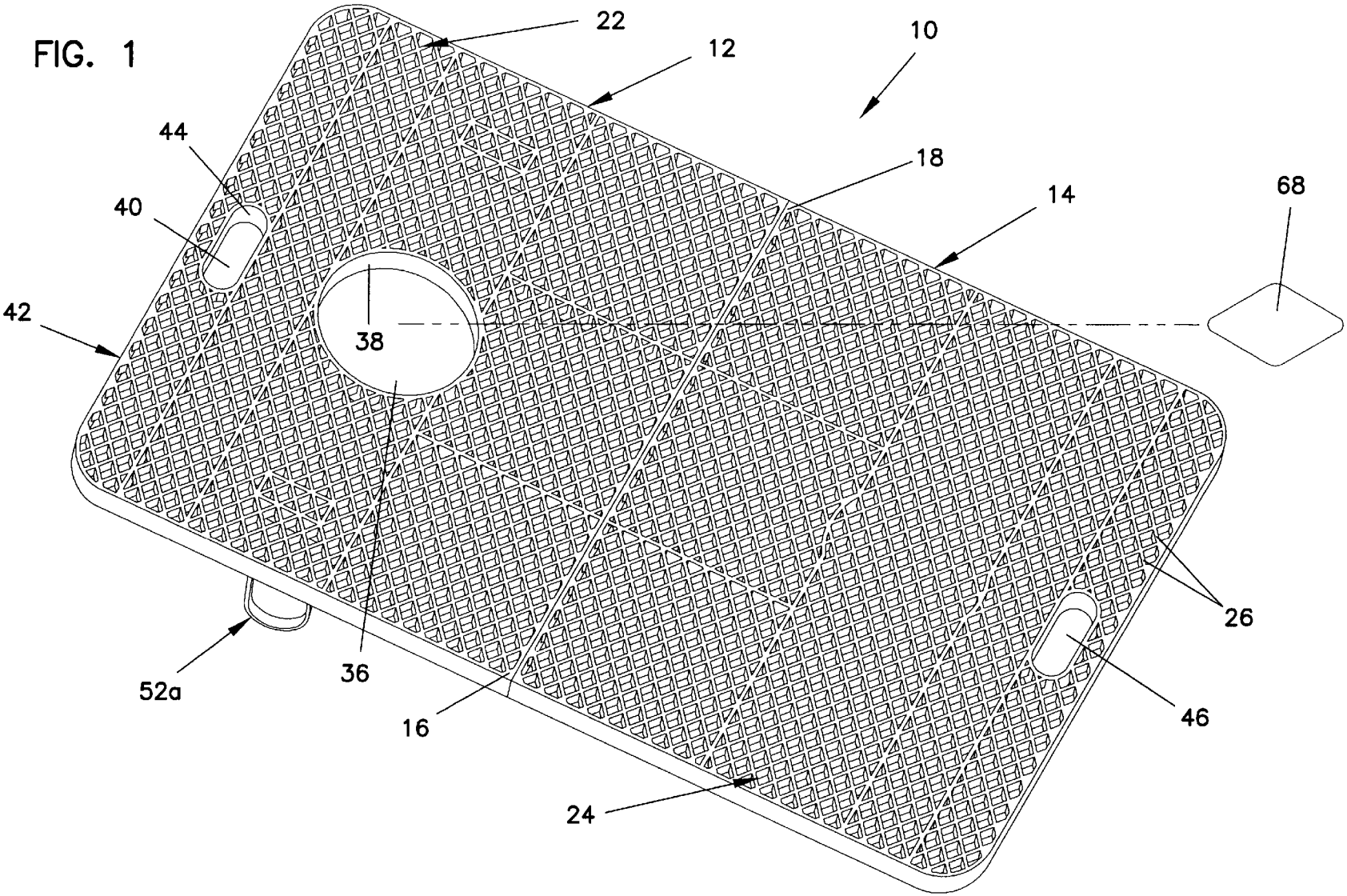
FIG. 1 is a perspective view of the target in the in-use configuration with the two panels being coplanar.
Figure 4:
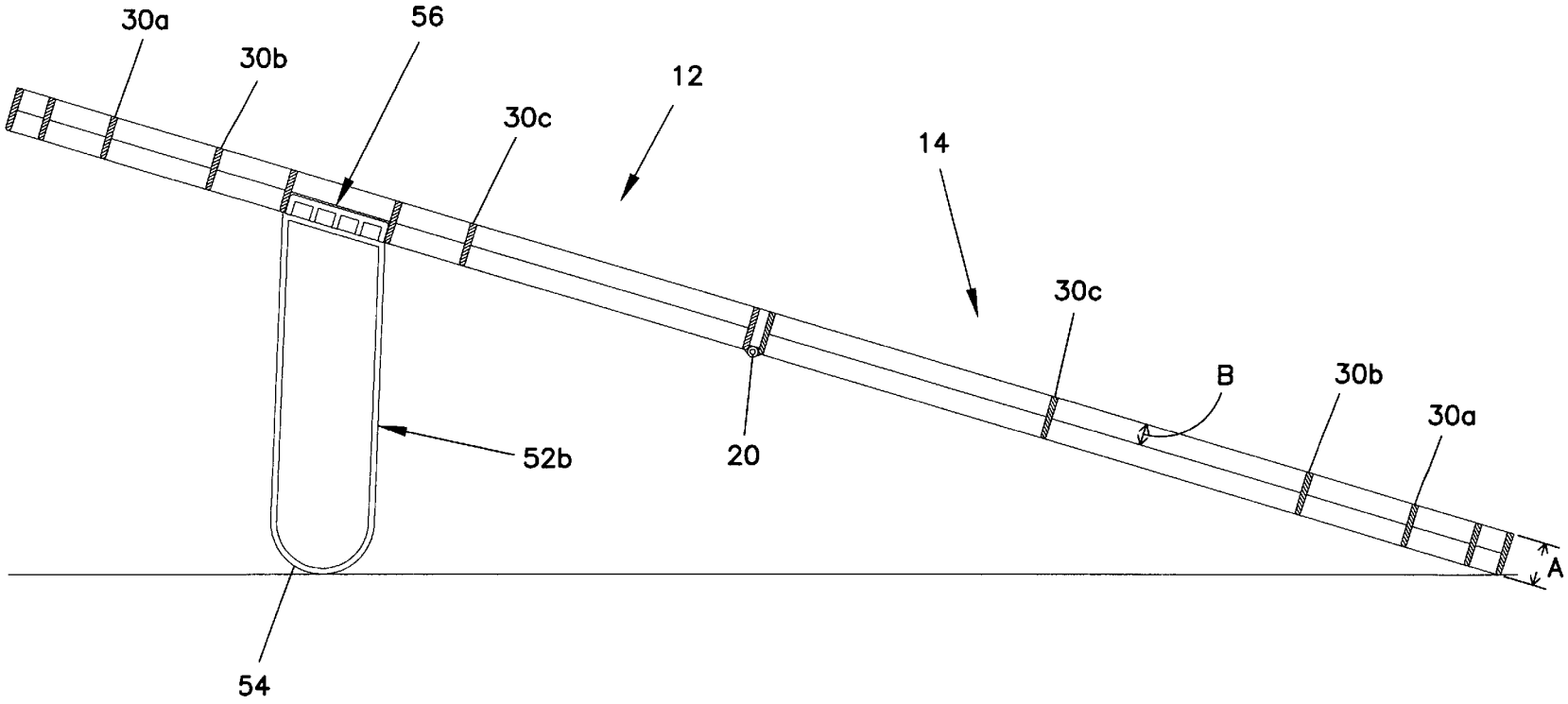
FIG. 4 is a sectional view through the two panels in FIG. 1 to illustrate the attachment of one support leg to the front panel.

The panels are connected together at edges 16,18 thereof by a hinge 20, to permit the panels to pivot between a first, in-use configuration in which the panels are coplanar, as shown in FIGS. 1 and 4, and a second, folded configuration in which the panels overlap each other in a back-to-back arrangement. As illustrated in FIG. 4, when the panels are in the in-use configuration, the panels are supported at an angle of at least about 20 degrees relative to the ground or other supporting surface, and preferably the angle is within the range of about 20–25 degrees, and the angle is most preferably about 20 degrees.

Figure 2:
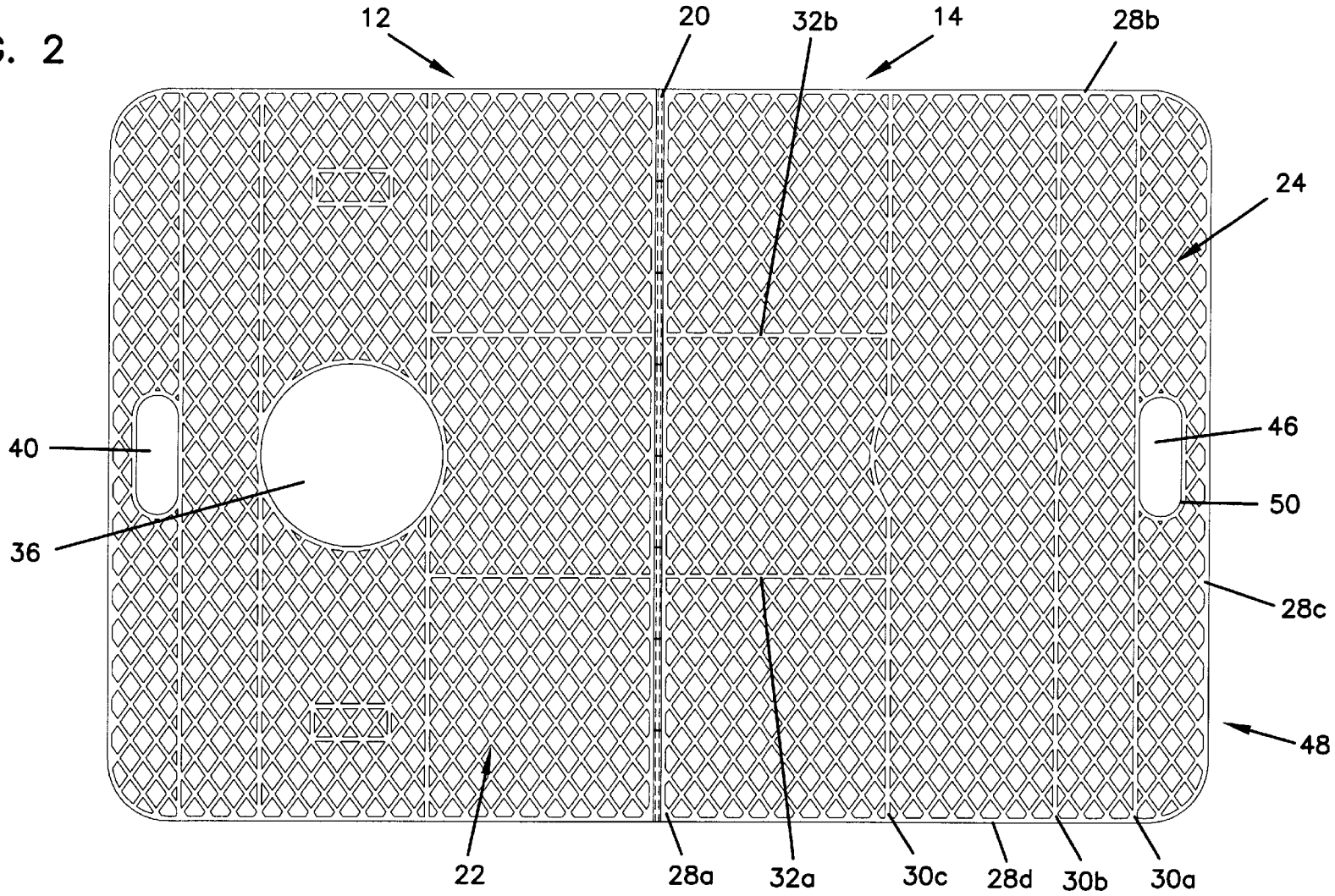
FIG. 2 is a top view of the two coplanar panels.
Figure 3:
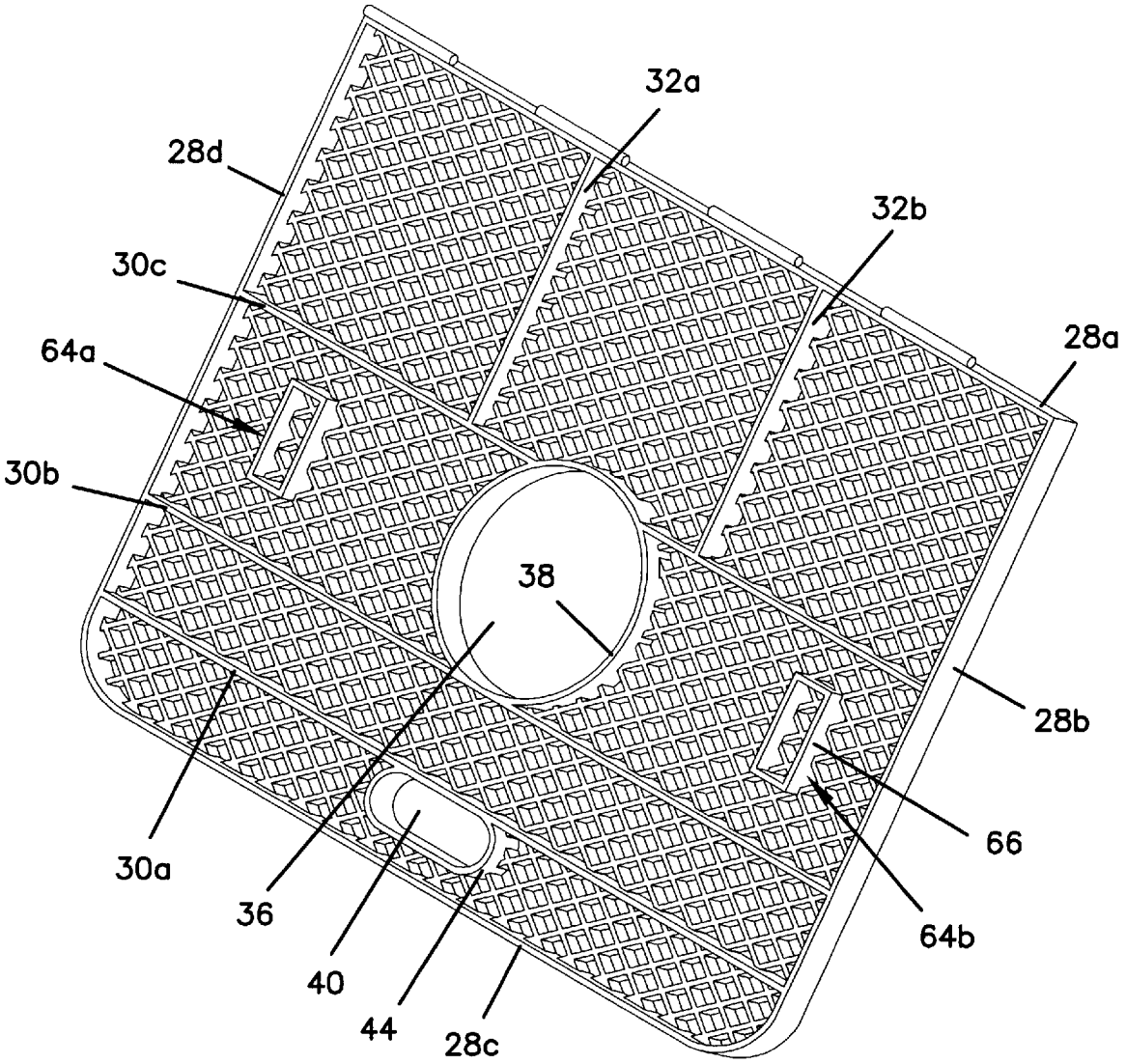
FIG. 3 is a view of the backside of the first panel, illustrating the arrangement of the lattice structure and the reinforcing ribs, and showing the arrangement of the mounts for the support legs.

Each panel 12,14 is composed of a lattice, honeycomb or like structure 22,24 formed by a series of crisscrossing ribs 26. The lattice structures 22,24 are open, i.e. without any structure between the ribs 26. Due to the latticed composition of each panel, the weight of the panels is reduced, thus making carrying of the target easier, while providing sufficient rigidity to the panels during use. Peripheral reinforcing ribs 28*a,b,c,d* extend around the edges of each panel to provide reinforcement thereto, as best shown in FIGS. 2–3. Further, a series of spaced, lateral reinforcing ribs 30*a,b,c* extend between the side ribs 28*b,* 28*d* of each panel, along with spaced, vertical reinforcing ribs 32*a,b* which extend between the top ribs 28*a* of the panels to the lateral rib 30*c*.

Figure 8:
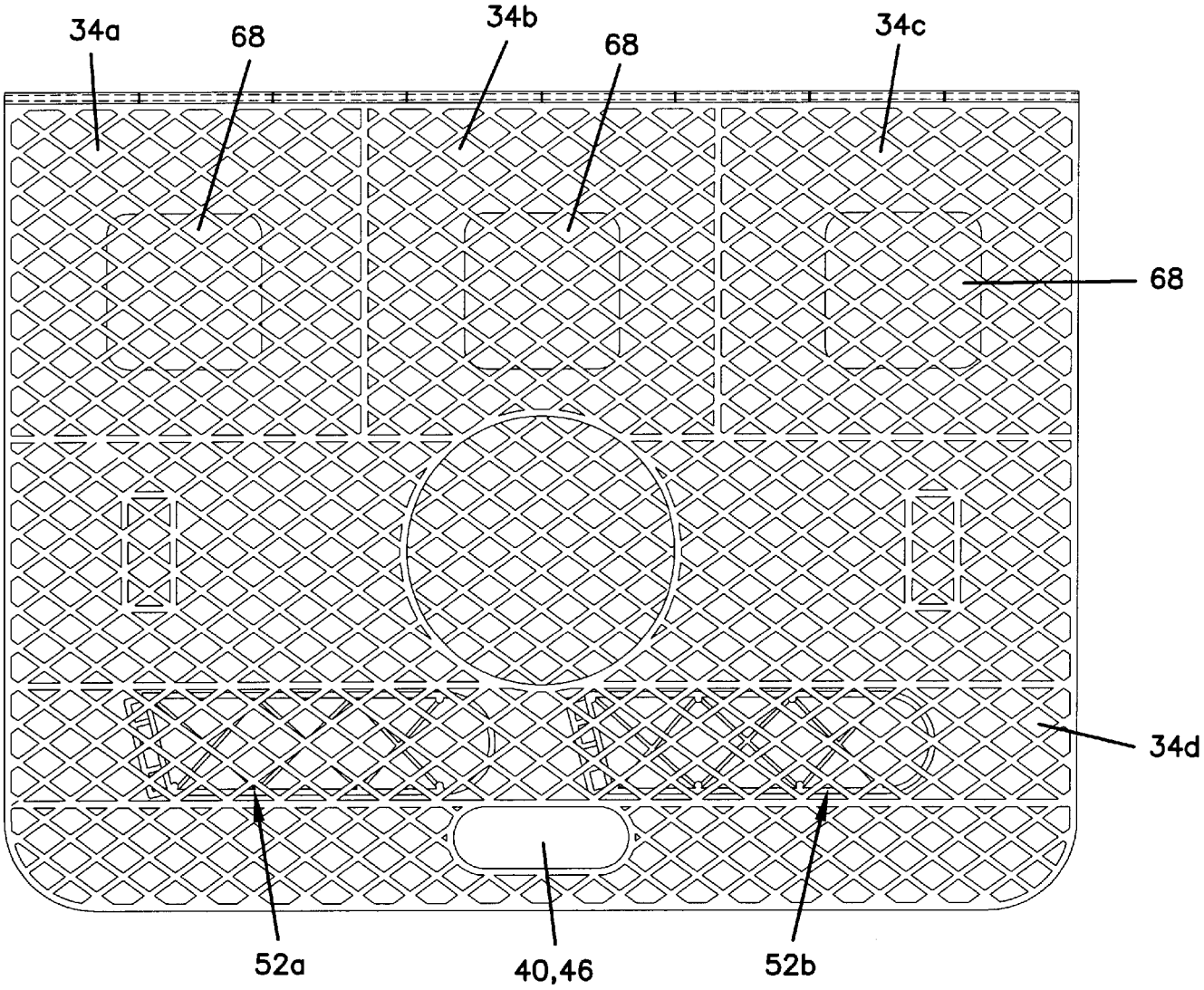
FIG. 8 is a view illustrating the two panels folded together so as to form the pockets, with the support legs and bags disposed in the pockets.

The thickness of the crisscrossing ribs 26 forming the lattice structure is less than the thickness of the reinforcing ribs 28*a–d*,30*a–c*,32*a–b*, such that when the panels are folded together, pockets are formed between the two panels. For instance, as illustrated in FIG. 4, the reinforcing ribs can have a thickness A of approximately 1.0 inch, while the crisscrossing ribs have a thickness B of from about 0.25 inches to 0.50 inches. Thus, when the panels are folded together, a series of pockets 34 *a,b,c,d . . . n* are defined between the lattice structures of each panel, with the pockets being separated by the reinforcing ribs, as shown in FIG. 8. The above dimensions are exemplary only, it being understood that other dimensions could be used, so long as the pockets are of sufficient size to be able to retain the support legs and bags, to be subsequently described, therein when the panels are folded together.

As best shown in FIGS. 1–3, the panel 12 includes a central target hole 36 therethrough, with a reinforcing rib 38 surrounding the hole. An elongate hole 40 is also formed through the panel 12 adjacent an edge 42 thereof, with a rib 44 surrounding the elongate hole. Similarly, the panel 14 includes an elongate hole 46 formed therethrough adjacent an edge 48, and defined by a rib 50. The elongate holes 40,46 are formed at corresponding locations on the respective panels, such that when the panels are folded together back-to-back, or overlapped, the elongate holes align with each other, thus forming a carrying handle by which the target can be carried when folded.

Figure 5:
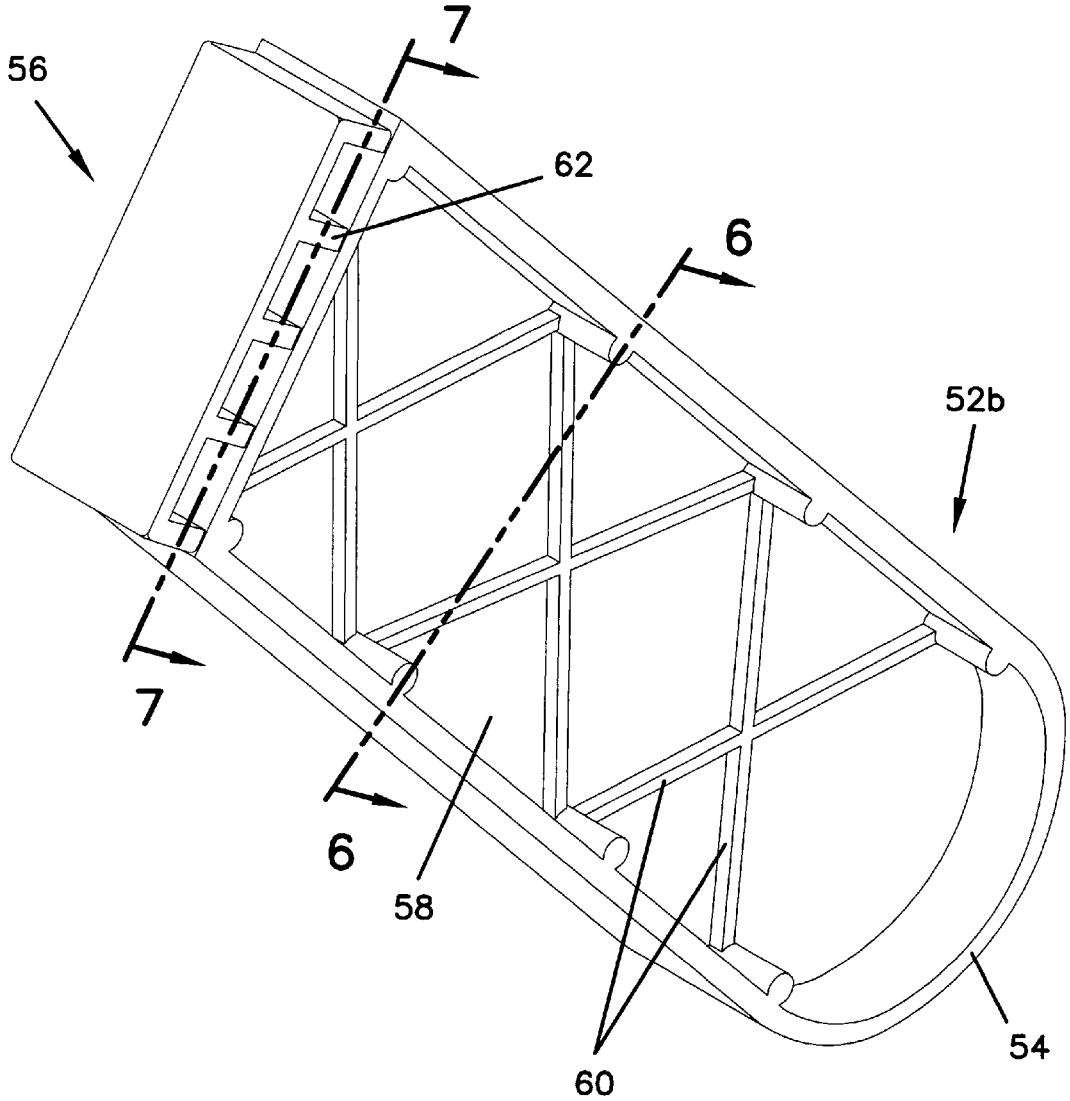
FIG. 5 is a perspective view of one of the support legs.
Figure 6:
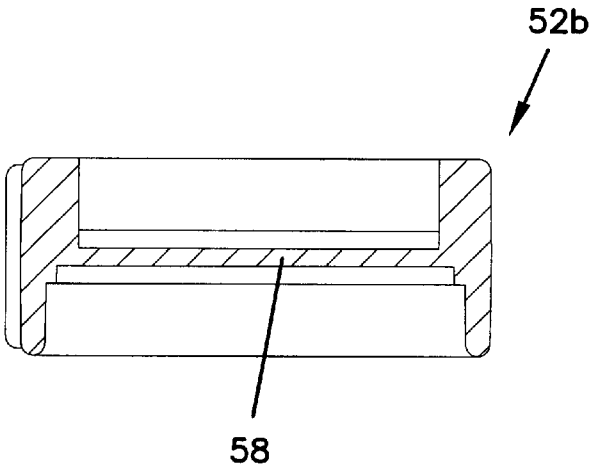
FIG. 6 is a cross-sectional view taken along line 6—6 of FIG. 5.
Figure 7:
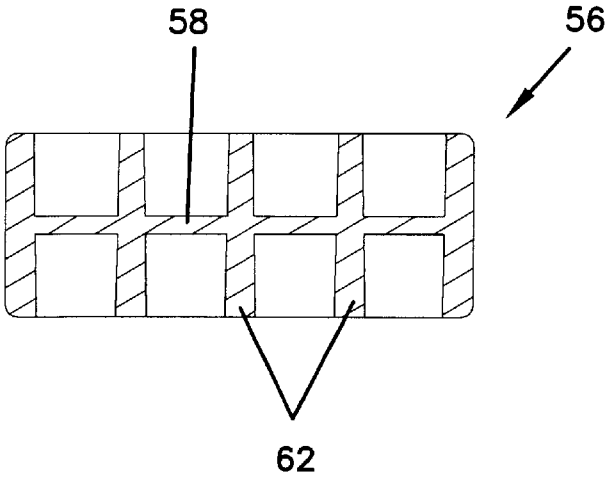
FIG. 7 is a cross-sectional view taken along line 7—7 of FIG. 5.

A pair of support legs 52*a*,52*b* are provided so as to support the panel 12 above the ground in the in-use configuration. Each leg, like the panels, is formed of an injection molded plastic material, such as polypropylene. FIGS. 5–7 illustrate the leg 52*b* in detail, it being understood that the leg 52*a* is identically constructed. The leg 52*b* is elongated and includes a first, rounded end 54 for resting on the ground or other supporting surface during use of the game, and a second, angled end 56. The support leg 52*b* is formed of a closed lattice structure including a central wall 58 extending between the first and second ends, with a plurality of crisscrossing ribs 60 disposed on each side of the wall 58 and extending between the sides of the legs for reinforcing the legs. The second end 56 is angled relative to the longitudinal axis of the leg so that the end 56 is generally parallel with the plane of the panel 12 when attached thereto, thus accommodating for the angle of the panel 12 when the target is in the in-use configuration. As shown in FIG. 7, the central wall 58 at the second end includes a plurality of reinforcing ribs 62 extending at right angles relative thereto, for reinforcing the second end.

As shown in FIG. 3, a pair of square mounts 64*a*,64*b* extend from the back side of the panel 12, for receiving the end 56 of the respective legs 52*a,b*. Each mount is formed by ribs 66 projecting a certain distance from the crisscrossing ribs 26. The mounts define rectangular recesses that are shaped so as to detachably receive the angled ends 56 of the legs therein, thus enabling the legs to be attached to the panel 12, as shown in FIG. 4, with the legs being removable when the target is to be folded. The ends 56 are removably received within the respective mounts 64*a,b* through a simple friction fit, to permit easy attachment/detachment of the legs, although other forms of attachment could be used. In use, the legs extend generally vertically relative to the ground or other support surface.

The legs 52*a,b* are also sized and shaped such that they can be disposed in the pocket 34*d* formed between the folded panels when not in use. As seen in FIG. 8, the legs can be nested within the pocket 34*d* formed between the reinforcing ribs 30*a*, 30*b*, by being laid end to end. Therefore, transport of the target is made easier since the legs do not have to be separately carried, and misplacement of the legs during storage is also prevented. Further, as also shown in FIG. 8, the bags 68 that are used during playing of the game can be nested within the pockets 34*a–c*, thus providing an easy way to carry the bags while preventing them from becoming lost. Thus it can be seen that all the components of the game (i.e. the target, support legs, and bags) can be conveniently carried and stored as a single unit when not in use. When the game is to be used, one simply pivots the two panels away from each other until they are coplanar, and places the edge 48 of the panel 14 on the ground. The two support legs are then attached to the mounts by fitting the ends 56 therein, with the ends 54 of the legs resting upon the ground. Thus, set-up of the game is simple and quick. Preferably, a game includes a plurality, preferably three, of the toss bags, although a different number of bags could be used. The bags 68 can be filled with beans, sand, beads and like materials, and can made in a variety of sizes and weights to accommodate different users.

Preferably, a game is played using two such targets 10, which are positioned a certain distance apart, with the holes in each target facing each other. Each contestant stands near one of the targets and attempts to toss, pitch, or otherwise project the bags through the target hole in the opposite target. The use of the game is believed to be otherwise obvious from the above description, and therefore no further mention is made of how to play the game.

It is to be understood that while certain embodiments of the present invention have been illustrated and described, the invention is not limited to the specific forms or arrangements of the parts described and shown.

I claim:

1. A bag tossing game target, comprising:

first and second generally planar, equally sized panels, said first and second panels connected together by a hinge whereby said first and second panels are moveable between a first, in-use configuration in which the first and second panels are coplanar, and a second, folded configuration in which the first and second panels lay back-to-back to each other;

said first panel having a hole therein, said hole being sized such that a bag can be tossed therethrough; and at least one support leg detachably secured to said first panel whereby in the in-use configuration said first panel is supported off the ground and an end of the second panel rests upon the ground.

2. The target according to claim 1, wherein said first and second panels are each formed of a lattice structure.

3. The target according to claim 2, wherein said first and second panels each further include reinforcement ribs, a plurality of said ribs on said first panel being aligned with a corresponding plurality of said ribs on said second panel when said first and second panels are in the folded configuration, and a plurality of pockets are formed between said first and second panels when said first and second panels are in the folded configuration, said pockets being defined between said aligned ribs and portions of the lattice structures of said first and second panels.

4. The target according to claim 3, wherein for each of said first and second panels, a thickness of said ribs is greater than a thickness of said lattice structure, whereby the pockets are formed due to the difference in thickness between the ribs and the lattice structure.

5. The target according to claim 3, further including a plurality of said support legs detachably secured to said first panel for supporting the first panel off the ground when the first and second panels are in the in-use configuration, wherein said support legs are sized and shaped such that said legs can nest within at least one of said pockets when said panels are in the folded configuration.

6. The target according to claim 5, wherein each said support leg is elongated and includes first and second ends, and further including a pair of mounts defined on said lattice structure of said first panel on opposite sides of said hole, said first end of each said support leg being removably disposed within a respective one of said mounts.

7. The target according to claim 6, wherein each said mount is defined by ribs projecting from said lattice structure, said ribs of each said mount defining a rectangular recess which receives said first end.

8. The target according to claim 1, wherein said first and second panels each include an elongated hole adjacent an edge thereof, said elongated holes being aligned with each other when said panels are in the folded configuration so as to form a handle for carrying the panels in the folded configuration of the panels.

9. A bag tossing game target disposed on a surface, comprising:

a rigid, generally planar structure formed by first and second equally sized panels connected together by a hinge at the center of the planar structure, said first and second panels being pivotable to a folded configuration where the first panel overlaps the second panel;

a hole formed through first panel, said hole being sized such that a bag can be tossed therethrough; and at least one support leg detachably connected to said first panel for supporting said first panel off the surface, with an end of said second panel resting upon the surface.

10. A bag tossing game, comprising:

at least one target structure and at least one bag for tossing at the target structure, wherein said target structure includes first and second generally planar, equally sized panels, said first and second panels connected together by a hinge whereby said first and second panels are moveable between a first, in-use configuration in which the first and second panels are coplanar, and a second, folded configuration in which the first and second panels lay back-to-back to each other;

said first panel having a hole therein, said hole being sized such that the bag can be tossed therethrough; and at least one support leg detachably secured to said first panel whereby in the in-use configuration said first panel is supported off the ground an end of the second panel rests upon the ground.

11. The bag tossing game according to claim 10, including a plurality of said target structures and a plurality of said bags.

12. The bag tossing game according to claim 10, wherein said first and second panels are each formed of a lattice structure.

13. The bag tossing game according to claim 12, wherein said first and second panels each further include reinforcement ribs, a plurality of said ribs on said first panel being aligned with a corresponding plurality of said ribs on said second panel when said first and second panels are in the folded configuration, and a plurality of pockets are formed between said first and second panels when said first and second panels are in the folded configuration, said pockets being defined between said aligned ribs and portions of the lattice structures of said first and second panels.

14. The bag tossing game according to claim 13, wherein for each of said first and second panels, a thickness of said ribs is greater than a thickness of said lattice structure, whereby the pockets are formed due to the difference in thickness between the ribs and the lattice structure.

15. The bag tossing game according to claim 13, further including a plurality of said support legs detachably secured to said first panel for supporting the first panel off the ground when the first and second panels are in the in-use configuration, wherein said support legs are sized and shaped such that said legs can nest within at least one of said pockets when said panels are in the folded configuration.

16. The bag tossing game according to claim 15, wherein each said support leg is elongated and includes first and second ends, and further including a pair of mounts defined on said lattice structure of said first panel on opposite sides of said hole, said first end of each said support leg being removably disposed within a respective one of said mounts.

17. The bag tossing game according to claim 16, wherein each said mount is defined by ribs projecting from said lattice structure, said ribs of each said mount defining a rectangular recess which receives said first end.

18. The bag tossing game according to claim 10, wherein said first and second panels each include an elongated hole adjacent an edge thereof, said elongated holes being aligned with each other when said panels are in the folded configuration so as to form a handle for carrying the panels in the folded configuration of the panels.

19. The bag tossing game according to claim 13, wherein the bag is sized and shaped such that the bag can nest within one of said pockets when said panels are in the folded configuration.

20. The bag tossing game according to claim 15, wherein in said in-use configuration, said first and second panels are supported at an angle of approximately 20–25 degrees relative to the support surface.

* * * * *